United States Patent [19]

Sisk

[11] Patent Number: 4,592,165

[45] Date of Patent: Jun. 3, 1986

[54] TREE GRATE

[76] Inventor: Thomas E. Sisk, 7815 Antoine, Houston, Tex. 77088

[21] Appl. No.: 588,812

[22] Filed: Mar. 12, 1984

[51] Int. Cl.[4] ..... A01G 17/00

[52] U.S. Cl. ..... 47/25

[58] Field of Search ..... 47/23–25, 47/32, 79, 26, 41, 41.1, 41.11, 41.12, 41.13, 41 SS, 41.2, 33

[56] References Cited

U.S. PATENT DOCUMENTS

| | | | |
|---|---|---|---|
| 109,098 | 11/1870 | Adams | 47/25 |
| 325,184 | 8/1885 | Nichols | 47/23 |
| 2,999,479 | 9/1961 | Carder | 47/24 X |
| 3,571,972 | 3/1971 | Carter | 47/25 |

FOREIGN PATENT DOCUMENTS

| | | | |
|---|---|---|---|
| 783798 | 7/1935 | France | 47/25 |
| 17699 | of 1898 | United Kingdom | 47/41.11 |
| 23811 | of 1911 | United Kingdom | 47/41.11 |
| 2053640 | 2/1981 | United Kingdom | 47/25 |

*Primary Examiner*—Robert A. Hafer
*Assistant Examiner*—Danton DeMille
*Attorney, Agent, or, Firm*—Bill B. Berryhill

[57] ABSTRACT

Improved grate for protectively surrounding the base of a tree, including a support ring for surrounding the tree at a radially spaced distance therefrom and a series of spirally disposed members, the proximal ends of which are affixed to the support ring and the distal ends of which generally define an opening through which the trunk of the tree may extend.

8 Claims, 5 Drawing Figures

TREE GRATE

BACKGROUND OF THE INVENTION

1. Field of the Invention

The present invention pertains to protective elements for covering the surrounding area of a tree or other plant. Specifically, the present invention pertains to a tree grate or cover for protectively surrounding the base of a tree while allowing water to reach the soil in which the tree is planted.

2. Description of the Prior Art

Trees or other plants are frequently planted in areas which may be substantially covered by concrete, asphalt or the like and subject to heavy pedestrian or automobile traffic. However, to allow water and nutrients to reach the plant roots, an area surrounding the plant may be left uncovered for this purpose. To allow a larger area to be uncovered by concrete, asphalt or the like, yet still allowing pedestrian or even automobile traffic, various types of grates may be provided around the plant. These grates are generally supported above the soil in which the plant is planted to allow pedestrian traffic yet providing openings therein to allow water and other nutrients to reach the soil.

One of the problems associated with protective plant grates, particularly those used with trees, is allowing for radial growth of the tree without leaving gaps between the grate and the tree which might cause a pedestrian to fall or be injured in some manner. In West German Pat. No. 25 17 949, the growth of the tree is accommodated by simply exchanging grating segments of larger openings with those of smaller openings as the tree grows. This, of course, is both time and material intensive, requiring a relatively large number of parts and constant monitoring and exchange of grating segments as the tree grows.

In United Kingdom Pat. No. 2,053,640 and U.S. Pat. No. 3,571,972, this problem is attempted to be solved by providing a covering around the tree, the inner portion of which is provided with radial flaps or fingers which flex or are forced upwardly around the trunk of the tree as the tree grows. This helps eliminate gaps around the tree as it grows without replacing the covering therearound. However, the upwardly extending flaps or fingers are still a potential source of accident and injury.

Still another solution to this problem is the type of grating shown in U.S. Pat. No. 4,308,688, which is installed with an opening closely surrounding the tree and as the tree grows, portions thereof are cut away to provide additional space for radial growth of the tree. This, of couse, requires continual monitoring and cutting away of the grate.

Thus, as can be seen, the search continues for a grate of superior safety and reduced maintenance.

SUMMARY OF THE PRESENT INVENTION

The present invention provides an improved grate for protectively surrounding the base of a tree while allowing water to reach the soil and permitting pedestrian traffic therearound. The grate may include a support ring for surrounding the tree at a radially spaced distance therefrom and a series of spirally disposed resilient members, the proximal ends of which are affixed to the support ring and the distal ends of which generally define an opening through which the trunk of the tree may extend from its base.

The distal ends of the spirally disposed members are free to move radially toward the support ring, in response to radial forces applied thereto, allowing for radial expansion of the opening in response to radial growth of the tree. A number of embodiments of the grate are disclosed utilizing various arrangements of the spirally disposed members.

The improved grate of the present invention thus offers a protective covering around a tree, allowing for radial growth of the tree and assuring that no dangerous gap or projection exists for potential accidents or injuries. Growth is accommodated by the grate without having to interchange parts thereof or without having to remove portions of the grate. Thus, the grate solves problems associated with protective tree coverings of the prior art in a very simple and efficient manner. The grate is relatively easy to manufacture and as a consequence should be relatively inexpensive. Many other objects and advantages of the invention will be apparent from reading the description which follows in conjunction with the accompanying drawings.

DESCRIPTION OF PREFERRED EMBODIMENTS

Figure 1:
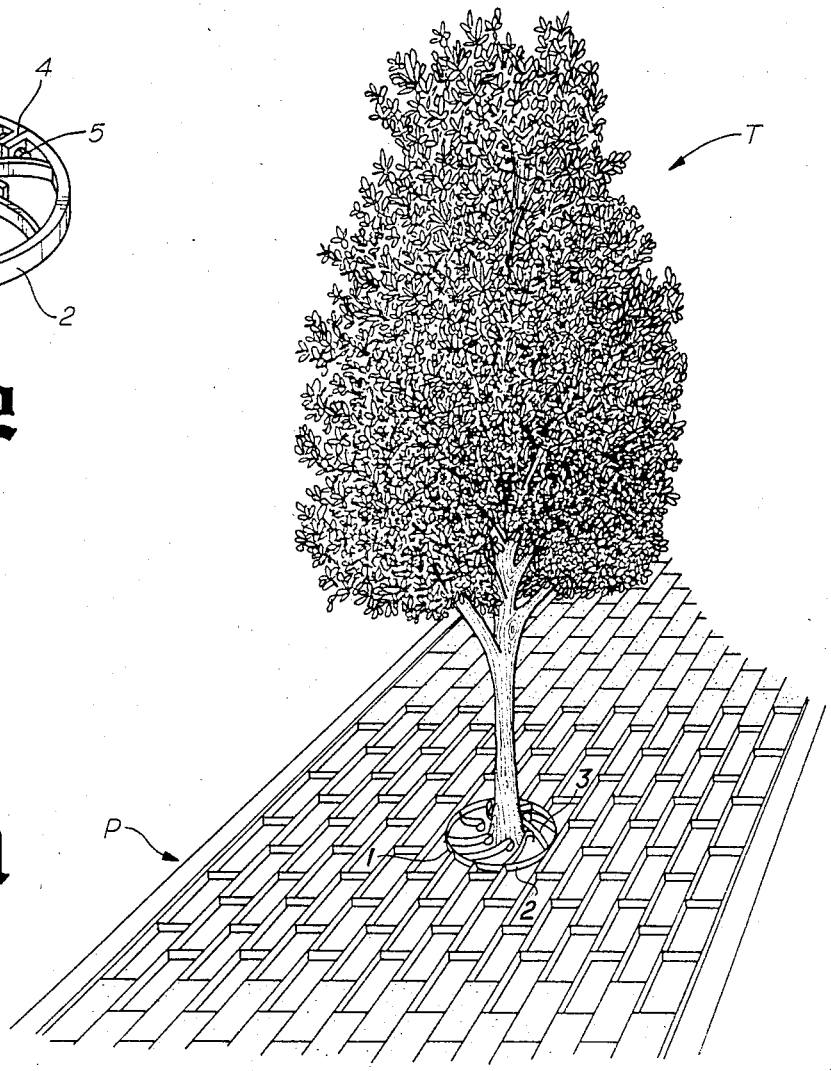
FIG. 1 is a pictorial illustration of an improved tree grate for protectively surrounding the base of a tree, according to a preferred embodiment of the invention.

Referring first to FIG. 1, there is shown a tree T generally surrounded by a protective rectangular grate P which in itself may be surrounded by concrete, asphalt or the like (not shown) such as in a shopping mall, or street. In the vicinity of the tree T and surrounding the base thereof is a circular grate 1 which is the subject of the present invention. The grate 1 may be welded or affixed in a hole provided therefor in the larger surrounding grate P or it may be simply placed in a well provided therein. The purpose of the grate 1 is to protect the tree T while allowing water and nutrients to reach the soil in which the tree is planted and permitting pedestrian or other traffic therearound.

Figure 2:
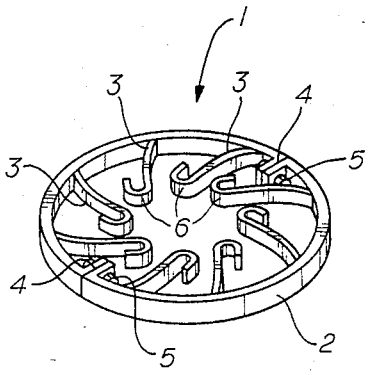
FIG. 2 is a perspective view showing the tree grate of FIG. 1 in greater detail.

As best seen in FIG. 2, the grate 1 includes a support ring 2 for surrounding a tree at a radially spaced distance therefrom. A series of spirally disposed resilient members 3 are affixed at the proximal ends thereof to the support ring 2. The distal ends of the spirally disposed members 3 generally define an opening through which the trunk of a tree may extend. The distal ends of the members 3 are free to move radially toward the support ring 2 in response to radial forces applied thereto, such as in the radial growth of a tree, to allow radial expansion of the opening. It is noted that the distal ends of the spirally disposed members 3 may be bent in a reverse curve to provide gradually curving surfaces for engagement with a tree upon the radial growth thereof. This also helps fill in some of the empty spaces between members 3.

The tree grate 1 may be made of a number of materials such as steel, ductile iron, aluminum, fiberglass, etc., so long as the material is sufficient to support the type of traffic to be borne thereby and is resilient enough to allow the members 3 to move toward the support ring 2 in response to radial growth of the tree. So that the grate 1 may be placed around a tree, such as T in FIG. 1, after the tree is in place, the support ring 2 may be manufactured as two semi-circular rings, as illustrated in FIG. 2, and provided with flange members 4 which may be attached by nuts and bolts 5.

Figure 3:
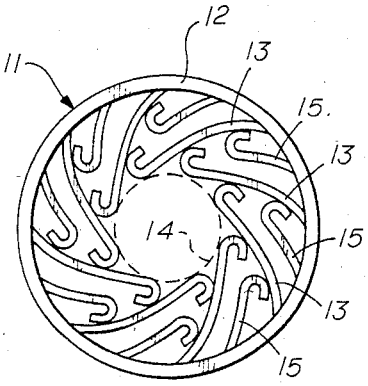
FIG. 3 is a plan view of a tree grate according to another preferred embodiment of the invention and illustrating the tree grate in an initial installed position surrounding a small tree.

In FIG. 3, an alternate embodiment of the invention is shown, which is very similar to the one shown in FIG. 2 in that it includes a support ring 12 and a series of spirally disposed members 13, the distal ends of which generally define an opening illustrated by the dotted line 14 through which the trunk of a tree may extend. There is, however, a second series of spirally disposed members 15, the proximal ends of which are affixed to the support ring 12, alternately with the first series of spirally disposed members 13, but the distal ends of which extend only partially toward the generally defined opening 14. By this arrangement, the second series of members 15 fill in gaps which exist between the members 13 of the first series which increase in width toward the support ring 12. Thus, potential gaps are eliminated.

Figure 4:
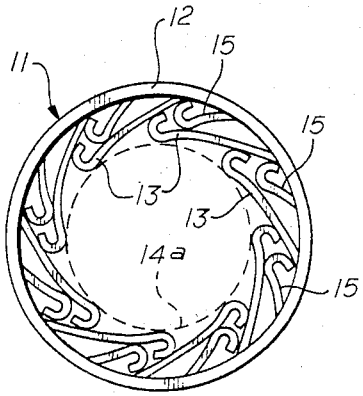
FIG. 4 is a plan view of the tree grate of FIG. 3 illustrating the grate after substantial growth of the tree.

FIG. 4 illustrates the same embodiment of the tree grate 11 shown in FIG. 3 but with the first and second series of spirally disposed members 13 and 15, respectively, shown after radial growth of a tree so as to force the members 13 to define a larger opening 14*a*. As can be seen, the second series of members 15 are also forced toward the support ring 12 by engagement with the first series of members 13.

Figure 5:
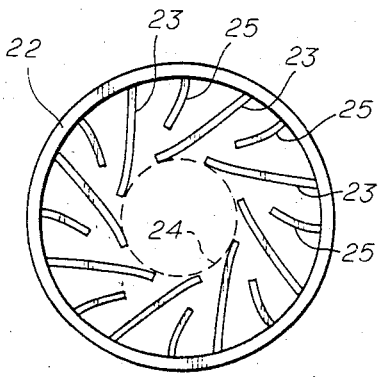
FIG. 5 is a plan view of another preferred embodiment of the invention.

It will be noted that each of the spirally disposed members in the embodiments of FIGS. 1, 2, 3, and 4 curves, from the distal ends thereof, toward the proximal ends thereof, in a generally clockwise direction relative to the support ring. In FIG. 5, an alternate embodiment of the invention is disclosed in which a first series of spirally disposed members 23 curves from the distal ends thereof toward the proximal ends thereof in a generally counterclockwise direction, relative to the support ring 22. If a second and shorter series of support members 25 is provided, they also may curve in a generally counterclockwise direction, relative to the support ring 22.

Thus, the present invention provides an improved grate for protectively surrounding the base of a tree while allowing water to reach the soil in which the tree is planted and permitting traffic therearound. The improved tree grate of the present invention allows for radial growth of the tree and continued coverage of potential gaps between the tree and grate without exchanging portions thereof or cutting away portions thereof. While the construction is simple, it is extremely effective and economical.

Several embodiments of the invention have been described herein. Additional embodiments and variations thereof can be made without departing from the spirit of the invention. Therefore, it is intended that the scope of the invention be limited only by the claims which follow.

I claim:

1. An improved grate for protectively surrounding the base of a tree while allowing water to reach the soil in which said tree is planted and permitting pedestrian traffic therearound, comprising:

a support ring for surrounding said tree at a radially spaced distance therefrom; and a series of spirally disposed resilient members the proximal ends of which are affixed to said support ring and the distal ends of which generally define an opening base, said distal ends of said resilient members being free to move radially toward said ring in a common plane therewith in response to radial forces applied thereto to allow radial expansion of said opening in response to the radial growth of said tree so as to provide continuous surfaces for pedestrian traffic around said tree in said common plane.

2. An improved tree grate as set forth in claim 1 in which said support ring comprises two attached semi-circular rings detachable to allow placement of said grate around said tree.

3. An improved tree grate as set forth in claim 1 in which the distal ends of said resilient members are bent in a reverse curve so that a gradually curved surface will engage said tree upon said radial growth thereof, said curved distal ends and the remainder of said resilient members providing said continuous common plane surfaces for said pedestrian traffic.

4. An improved tree grate as set forth in claim 1 in which each of said spirally disposed members curves from said distal ends thereof toward said proximal ends thereof in a generally clockwise direction, relative to said support ring.

5. An improved tree grate as set forth in claim 1 including a second series of spirally disposed members the proximal ends of which are affixed to said support ring alternately with said first mentioned series of spirally disposed members and the distal ends of which extend only partially toward said generally defined opening and also providing said continuous common plane surfaces for pedestrian traffic around said tree.

6. An improved tree grate as set forth in claim 5 in which the distal ends of said first and second spirally disposed members are bent in a reverse curve so that gradually curved surfaces are presented toward said generally defined opening for eventual engagement with said tree upon said radial growth thereof, said curved distal ends and the remainder of said resilient members providing said continuous common plane surfaces for pedestrian traffic around said tree.

7. An improved tree grate as set forth in claim 5 in which each of said spirally disposed members curves from said distal ends thereof toward said proximal ends thereof in a generally clockwise direction, relative to said support ring.

8. An improved tree grate as set forth in claim 5 in which each of said spirally disposed members curves from said distal ends thereof toward said proximal ends thereof in a generally counterclockwise direction, relative to said support ring.

* * * * *